US006621054B2

(12) United States Patent
Von Mosshaim

(10) Patent No.: US 6,621,054 B2
(45) Date of Patent: Sep. 16, 2003

(54) MODULAR HOT PLATES

(76) Inventor: Horst Mosshammer Von Mosshaim, 8773 Lazelle Village Dr., Lewis Center, OH (US) 43035

( * ) Notice: Subject to any disclaimer, the term of this patent is extended or adjusted under 35 U.S.C. 154(b) by 0 days.

(21) Appl. No.: 09/928,120

(22) Filed: Aug. 10, 2001

(65) Prior Publication Data

US 2002/0033390 A1 Mar. 21, 2002

Related U.S. Application Data

(63) Continuation-in-part of application No. 09/403,904, filed on Oct. 28, 1999, now Pat. No. 6,274,848.

(30) Foreign Application Priority Data

Jan. 26, 1997 (ZA) ..... 96/6369

(51) Int. Cl.[7] ..... H05B 3/68
(52) U.S. Cl. ..... 219/452.11; 219/460.1
(58) Field of Search ..... 219/450.1, 452.1, 219/452.11, 460.1, 461.1, 462.1; 126/39 H, 39 J, 90 A, 92 A

(56) References Cited

U.S. PATENT DOCUMENTS

| | | | | |
|---|---|---|---|---|
| 2,548,932 A | | 4/1951 | Ball | |
| 2,563,875 A | | 8/1951 | Salton | |
| 3,026,393 A | | 3/1962 | Quirk | |
| 3,361,126 A | | 1/1968 | Bloomfield | |
| 3,489,880 A | | 1/1970 | Bloomfield et al. | |
| 3,632,983 A | | 1/1972 | Dills | |
| 3,648,659 A | | 3/1972 | Jones | |
| 3,870,862 A | * | 3/1975 | Doner | 219/452.12 |
| 3,956,612 A | | 5/1976 | Ballard et al. | |
| 4,072,091 A | | 2/1978 | Richardson | |
| 4,164,644 A | | 8/1979 | Remsnyder et al. | |
| 4,164,645 A | | 8/1979 | Dogliotti | |
| 4,726,288 A | | 2/1988 | Lansing | |
| 4,788,414 A | | 11/1988 | Schreder | |
| 4,899,722 A | | 2/1990 | Horewitch | |
| 4,900,899 A | | 2/1990 | Schreder et al. | |
| 4,996,410 A | | 2/1991 | Ho | |
| 5,012,791 A | | 5/1991 | McCabe | |
| 5,045,672 A | | 9/1991 | Scott | |
| 5,119,800 A | | 6/1992 | Roberts et al. | |
| 5,160,830 A | | 11/1992 | Kicherer et al. | |
| 5,211,157 A | | 5/1993 | Schwartz et al. | |
| 5,290,997 A | | 3/1994 | Iai et al. | |
| 5,453,596 A | | 9/1995 | Verveniotis | |
| 5,508,495 A | | 4/1996 | Yahav et al. | |
| 5,530,224 A | | 6/1996 | Sassman | |
| 5,532,458 A | * | 7/1996 | Kratel et al. | 219/460.1 |

(List continued on next page.)

FOREIGN PATENT DOCUMENTS

| | | |
|---|---|---|
| DE | 30 04 105 | 8/1981 |
| DE | 40 07 680 | 9/1991 |
| EP | 0 428 230 | 5/1991 |
| EP | 0 696 430 | 2/1996 |

*Primary Examiner*—Sang Paik
(74) *Attorney, Agent, or Firm*—Buckingham, Doolittle & Burroughs, LLP

(57) ABSTRACT

The invention discloses a hot plate unit having an outer housing, at least one inner housing within said outer housing, at least one ribbon or radiant heating element within said at least one inner housing, an insulating means around at least one of said heating elements, and a ceramic top on said outer housing. The insulating means preferably is an inner insulating means and an outer insulating means, preferably with a bottom insulating means. In one embodiment, the outer insulating is cylindrical having an inwardly facing shelf at a bottom thereof with a bottom insulating means which is essentially plate-like. In another embodiment, the outer insulating means is cylindrical and with a bottom insulating means which is cup-shaped having a bottom and beveled raised sides.

19 Claims, 8 Drawing Sheets

U.S. PATENT DOCUMENTS

| | | | |
|---|---|---|---|
| 5,567,458 | A | 10/1996 | Wu |
| 5,638,808 | A | 6/1997 | Home |
| 5,977,521 | A | 11/1999 | Mehta et al. |
| 5,981,914 | A | 11/1999 | Schultheis |
| 6,100,507 | A | 8/2000 | von Mosshaim |
| 6,111,224 | A | 8/2000 | Witt |
| 6,274,848 | B1 | 8/2001 | von Mosshaim |

* cited by examiner

FIG-1
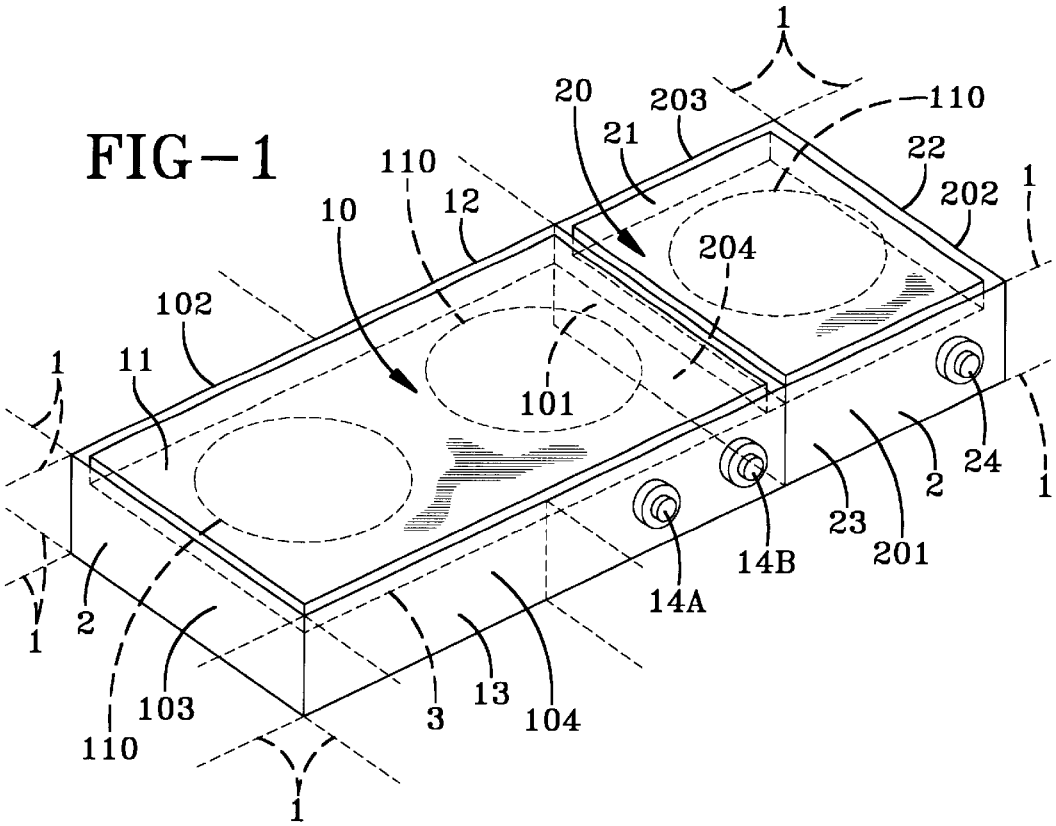
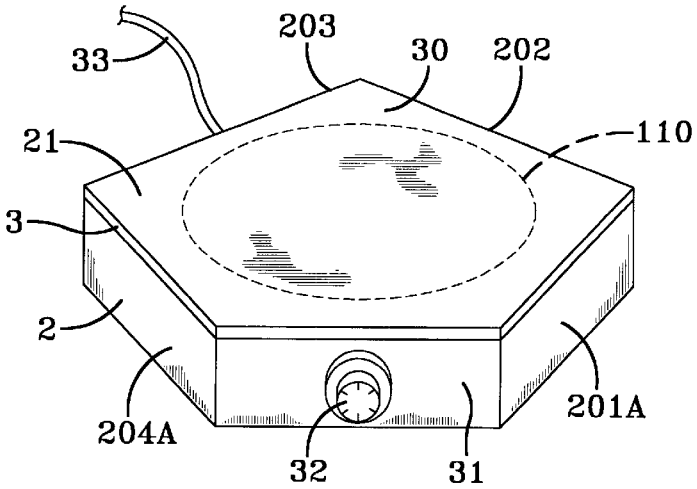
FIG-2

MODULAR HOT PLATES

This application is a continuation-in-part of application No. 09/403,904 filed Oct. 28, 1999 now U.S. Pat. No. 6,274,848.

TECHNICAL FIELD

The invention relates to table model hot plates for cooking, i.e., self-supporting hot plates for use on a table or like support as distinct on the one hand from cooking plates for fixed installation in the working surface of build-in hot plates of free-standing cooking ranges or stoves.

BACKGROUND OF THE INVENTION

In all of the foregoing, vitreous ceramic tops (a glass-like heat resistant material) covering one or more radiant heating element bodies are becoming increasingly popular because of their appearance, easily cleaned cooking surface and high energy efficiency. Conventionally, if such appliances comprise a plurality of cooking positions, often three or more, each having its own individual, independently controllable radiant heating element body or body set, a single vitreous ceramic top is used to cover all of these. Such large vitreous ceramic tops are relatively expensive and suffer from the disadvantage that any breakage, even if affecting only a small part, e.g., only one of the cooking positions, necessitates replacement of the entire top.

The conventional constructions also afford a very limited range of variety, because it would usually be uneconomical to manufacture more than a small selection of combinations of cooking or warming positions to fit any particular size of vitreous ceramic top. Also, even within such limited scope for variation, if at any stage it should become necessary to change an existing combination, e.g., of different sizes or shapes of cooking positions, it will normally be necessary to replace the entire unit.

Conventional permanently installed constructions usually only lend themselves to a limited choice of installation localities within a given kitchen design. For example, the conventional tops of standard appliances such as dishwashers, washing machines or tumble dryers do not normally lend themselves for use as supports for a cooking surface. The same applies to loose items of furniture, such as tables or serving trolleys, to mention but a few examples.

A further disadvantage of conventional cooking and warming appliances forming part of permanently installed kitchen furniture is their immobility. If mobility is required, the user will have to invest in additional mobile appliances such as separate table top model hot plates or warming plates and find storage place for such appliances when not in use.

All of the above drawbacks are of even greater impact in the usual domestic environment of disadvantages population groups where housing conditions may be confined and cramped and where funds for investment in cooking and warming appliances are limited.

These disadvantages however, also apply in the case of caravans (trailer homes), dormobiles and holiday cabins, where greater mobility of cooking appliances would be a desirable feature.

On the other hand, ordinary movable table top hot plates and warming plates do not solve these problems either. They are but a poor substitute for a built-in or free-standing kitchen range. One of the former alone is usually too small, having fewer than the desired number and less variety of cooking points. Yet to employ two or more of these side by side is unsatisfactory from points of view of aesthetics, space utilization and cleaning.

There accordingly exists a need to overcome the foregoing disadvantages.

SUMMARY OF THE INVENTION

The present invention now provides a set of modular table model hot plates for cooking having substantially square or rectangular outlines in plan view, comprising the following features in combination:

(a) each hot plate forms a module having one or more sides of the square or rectangular outlines exactly matching one or more sides of one or more other hot plates of the set when placed in close fitting side by side relationship;

(b) each hot plate of the set having a vitreous ceramic top covering one or more radiant heating element bodies;

(c) each vitreous ceramic tops of the set, when the individual modules are placed side by side with said matching sides in close fitting contact, combine to form a level top surface, interrupted by joint lines of minimal width between the vitreous ceramic tops. The vitreous ceramic tops, which are preferably adhesively bonded in conventional manner onto a marginal shoulder or flange at the top of the base of each unit have outlines as closely as practical matching the plan view outlines of the sides of the units but not projecting these beyond in order not to interfere with the close fitting contact of the sides of adjoining units. A conventional silicone adhesive may be used for bonding the vitreous ceramic top onto the shoulder or flange.

Optionally, but not preferably each vitreous ceramic top may be bordered by retaining ledges, one or more of which constitute the upper part of a side as defined in (a). Although these retaining ledges facilitate positioning of the vitreous ceramic tops during assembly and obviate the use of assembly jigs, they impose limitations on the extent to which the joint between adjoining vitreous ceramic tops can be minimized due to the minimum thickness of the material (usually sheet metal) of the ledges.

These ledges, if present, may be as narrow as about 0.5–2.5, more preferably 0.7 to 0.7 mm, say 1 mm. More preferably the ledges are omitted entirely, permitting the vitreous ceramic tops to adjoin as closely as manufacturing tolerances allow.

Preferably the side lengths of the modules are equal to form one or more square modules, or when different, the longer side lengths are whole number multiples of the shorter side lengths. These side lengths are preferably selected so that they or multiples thereof substantially correspond to standard side lengths of table and appliance tops, in particular standard table tops in modular kitchen furniture.

Preferably one side, usually the front of each module is designed as a control panel carrying operating and/or control buttons, touch pads, knobs, and/or dials and optionally one or more pilot lights.

A particular embodiment of such set includes a corner module having essentially square or rectangular outlines as aforesaid, but modified in that one corner is chamfered to form a fifth side, which is preferably considerably shorter than any of the remaining sides, being designed as a control panel carrying operating and/or control buttons, touch pads, knobs or dials and optionally one or more pilot lights.

In use such a set may comprise a plurality of modules arrayed in an L-shaped configuration with a corner module as aforesaid forming the corner of the L. Alternatively, at least one said corner module is set up for the chamfered corner to be at an end of a rectilinear succession of modules. Advantageously, the set includes locating and position retaining mean for retaining the modules in their relative positions having been placed in a selected array. For example, the locating and position retaining means are devices adapted to engage with support buttons or feet of adjoining modules. Alternatively, the locating and position retaining means are catches or clips for locking together the adjoining sides of adjoining modules.

The scope of the invention extends to the individual modules of the set adapted to be used in combination as described above, more particularly by incorporating some or all of the features as set out above.

The individual modules may be supplied with plans and/or instructions, e.g., in or on a package, e.g., a carton containing one or more modules explaining layouts for combining modules in advantageous arrays.

The invention further includes in its scope, a pentagonal table model hot plate, usable as a corner module in a set as disclosed above having square or rectangular outlines as aforesaid, one corner of which is chamfered to form a fifth side, this fifth side being designed as a control panel carrying operating and/or control buttons, touch pads, knobs or dials and optionally one or more pilot lights. Besides the visual attractiveness of this design the construction offers the advantage that, when placed on a rectangular or square table or like support, the operating and control means are protected by being recessed in relation to the corner of the support.

These and other objects of this invention will be evident when viewed in light of the drawings, detailed description, and appended claims.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof, and wherein:

FIG. 1 is an isometric projection of a set of two hot plate modules, assembled in a linear array;

FIG. 2 is an isometric projection of a corner hot plate module, suitable as part of a set including a chamfered corner;

DETAILED DESCRIPTION OF THE INVENTION

Figure 3:
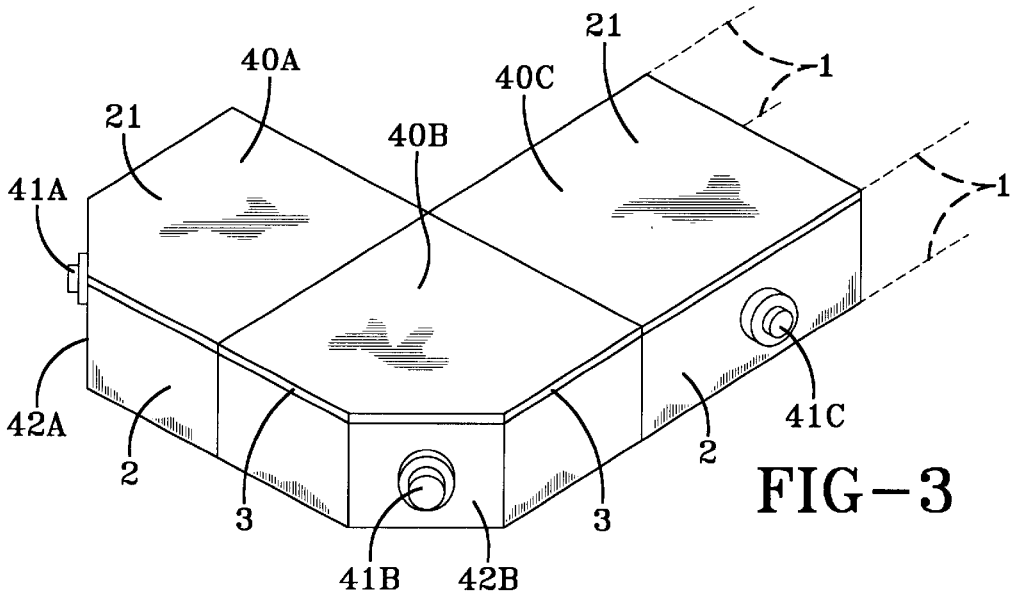
FIG. 3 is an isometric projection of three hot plate modules of a set arranged in an L-shaped configuration.

Referring now to the drawings wherein the showings are for purposes of illustrating the preferred embodiment of the invention only and not for purposes of limiting the same, the Figures show modular hot plates that can be combined in various ways.

In FIG. 1, there is shown two hot plate modules 10 and 20 combined in a linear array. Hot plate module 10 has rectangular outlines in plan view and hot plate module 20 has square outlines in plan view. Each square hot plate module 20 has four sides of equal length 201, 202, 203, and 204. Each rectangular hot plate module 10 has two opposite short sides 101 and 103 exactly matching in length a side of the square module 20 and two equal opposite long sides 102, 104 the length of which is a multiple, in this example twice the length of the short sides 101, 103.

The hot plates include a base 2, having said rectangular outlines and a vitreous ceramic top 11, 21 covering one or more radiant heating element bodies 110. Each vitreous ceramic top 11, 21 may be bordered by retaining ledges 12, 22 the thickness of which have been greatly exaggerated in the drawing, being in practice only about 1 mm thick, and which if present, constitute the upper part of the sides of the hot plate module. Alternatively and preferably the retaining ledges are omitted entirely.

The vitreous ceramic tops are each bonded with silicone or equivalent adhesive onto a shoulder or marginal flange at 3.

The broken lines 1 indicate that further modules can be added on in a variety of manners to extend the array of modules as needed and to match an available kitchen furniture top area or other working top area. It is clear that the set of modules offers a great many options to meet customer requirements at any given time, while permitting the removal of individual modules for temporary use elsewhere, e.g., in a different room or even outdoors.

The hot plate modules are placed side by side with the matching sides in close fitting contact so that the vitreous ceramic tops 11, 21 of the hot plates combine to form a top level surface, interrupted only by the joint lines formed by the retaining ledges 12 and 22.

The longer side lengths of the hot plate module 10 as shown are twice the length of the shorter side lengths. However, it will be understood that modules may be provided having longer side lengths three or more times the shorter side length.

The front side of the modules 13, 23 are designed as control panels carrying control dials 14A, 14B and 24 and optionally pilot lights. The control dials switch on and off and control the temperature of the ribbon or radiant heating element bodies 110.

The direction in which the control panels of the individual modules are made to face in a given array is optional.

In FIG. 2 there is shown a corner hot plate modules having essentially the same square outlines as module 20 in FIG. 1 but modified in that one corner is chamfered to form a fifth side 31 connecting the shortened sides 201*a* and 204*a*. The fifth side 31 is considerably shorter than any of the remaining sides and is designed as a control panel and carries a control dial 32 for switching on and off and controlling the temperature of the radiant heating element bodies 110. The module includes a power supply cord 33.

FIG. 3 illustrates three hot plate modules 40A, 40B and 40C (the later identical to square module 20 in FIG. 1) arranged in an L-shaped configuration with a corner module 40B as shown in FIG. 2 having a chamfered corner to form a fifth side 42B forming the corner of the L. In addition, a second corner module 40A is set up for fifth side 42A resulting from the chamfered corner to be at an end of the L-shape. As in FIG. 1, broken lines 1 diagrammatically indicate an optional extension of the array with one or more further modules.

Each module includes a control panel (the fifth side of the corner modules) which carries a control dial 41A, 41B and 41C for controlling the temperature of the ribbon or radiant heating element bodies (not shown).

Figure 4:
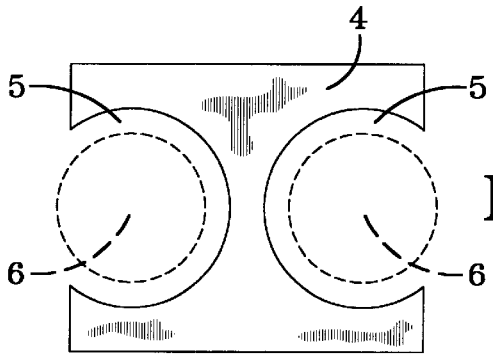
FIG. 4 is a perspective elevation of three hot plate modules of a set arranged in rectilinear succession.

FIG. 4 illustrates three modules 50A, 50B and 50C arranged in rectilinear succession. Two corner modules 50A and 50C as shown in FIG. 2 are set up for the fifth sides 52A and 52C resulting from the chamfered corners to be at either end of the succession of modules. The intermediate module 50B is a square module like module 20 in FIG. 1 or could be a rectangular module like module 10 in FIG. 1. Each module carries a control dial 51A, 51B and 51C on the front control panel (the fifth side in the corner modules). The control dial is for controlling the temperature of the radiant element heating bodies (not shown).

Figure 5:
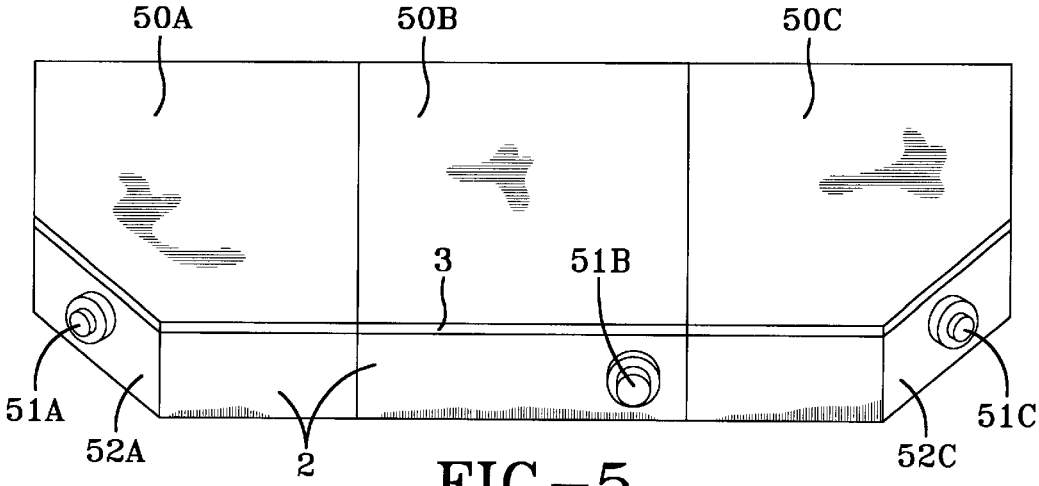
FIG. 5 represents a plan view of a locating clip for holding together adjoining modules of a set.

Referring now to FIG. 5, a resilient clip 4 of rubber is shown having open-ended rebates 5 for accommodating rubber feet 6 on the underside of the corner regions of adjoining modules (not shown). These clips represent one of a variety of possibilities for optionally stabilizing the relative positions of adjoining modules in a given array.

Figure 6:
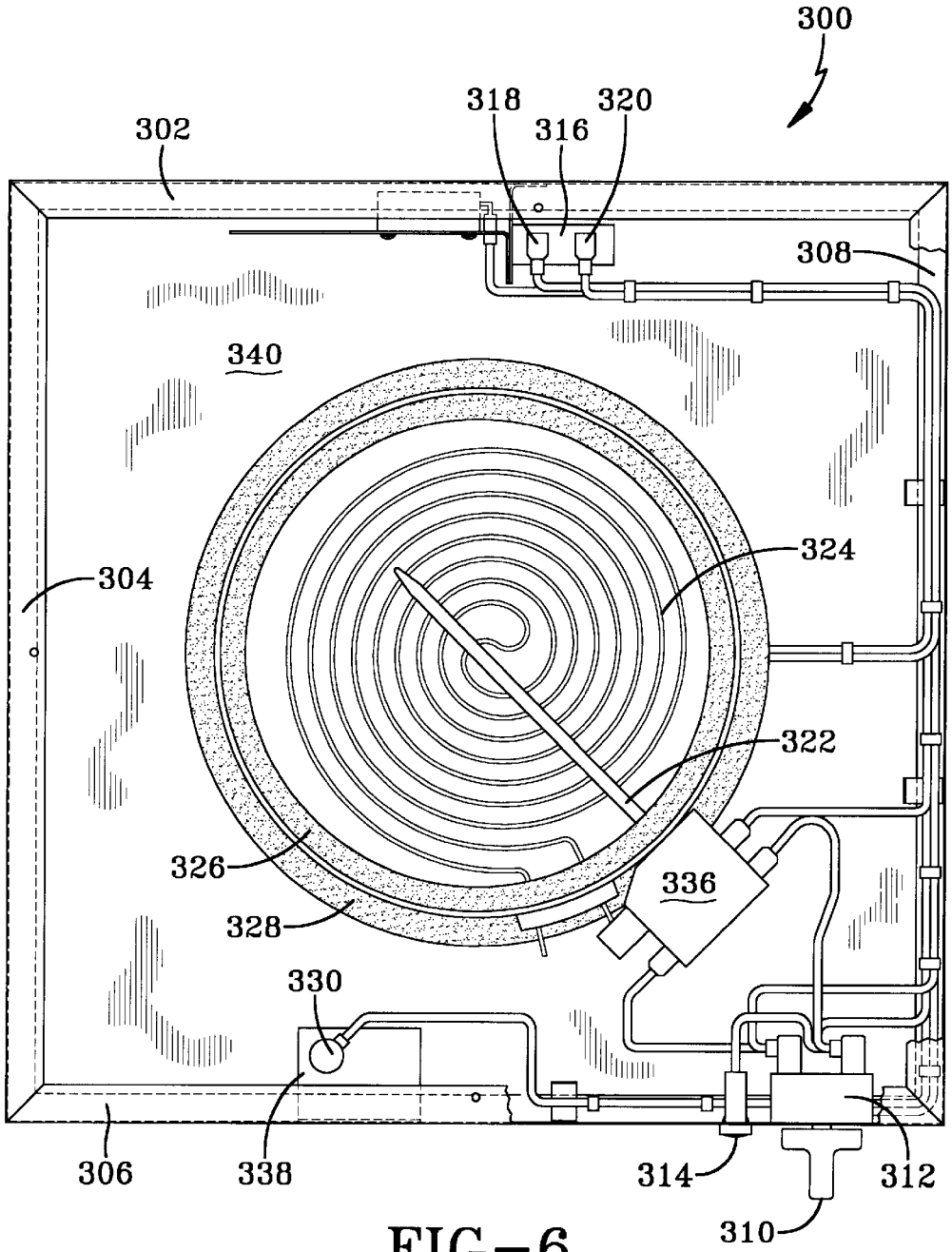
FIG-6 PRIOR ART
FIG. 6 is a top plan view of a Prior Art single hot plate with serpentine radiant heating element with vitreous ceramic top shown in ghost lines.

FIG. 6 illustrates a top plan view of a Prior Art single hot plate 300 with vitreous ceramic top 340 shown outlined in ghost lines. The hot plate has an outer housing with four connected walls, 302, 304, 306, 308 shown in a square configuration, although rectangular and chamfered arrangements as described above are within the scope of this invention. Raceways are optionally positioned within the walls for containment of electrical wiring harnesses. Electrical communication with household current is effected through alternating current (AC) inlet 316 having a neutral 318, hot 320 and typically neutral (not shown) wire. Heating is effected via ribbon or serpentine heating element 324 with continuously variable control 310 using rheostat 312. Visual indication of heating is observed via pilot light 314. Temperature control is maintained via feedback circuitry 336 predicated on readings from temperature sensor 322. Lateral heat migration is minimized through circular insulating rings 326, 328 positioned about heating element 324. Residual hot surface protection is effected via residual heat indicator light 330 positioned within residual heat indicator light bracket 338.

Figure 7:
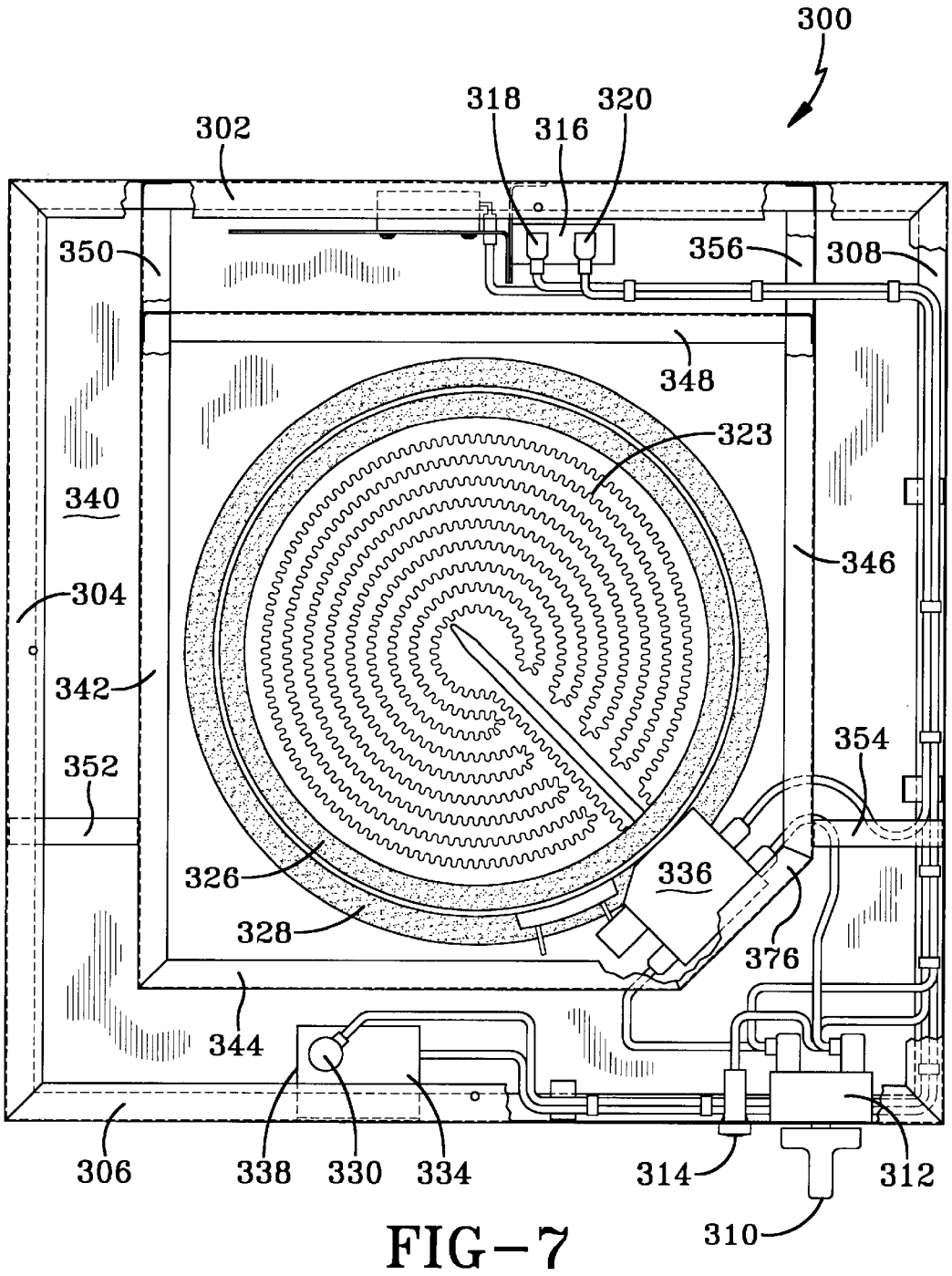
FIG. 7 is a top plan view of a single hot plate of the invention with inner housing within an outer housing with ribbon heating element and vitreous ceramic top shown in ghost lines.

As best illustrated in FIG. 7, the invention which more effectively minimizes lateral heat migration, particularly when EGO HiLight ribbon heating elements 323 are used, builds on the components identified in FIG. 6 and adds an inner housing comprising four connected walls 342, 344, 346, 348 of dimensions smaller than those of outer housing connected walls 302, 304, 306 and 308. It should be noted that the reduction in size of the inner walls need not be in the same ratio for all walls, and that chamfered walls 376 are also envisioned within the scope of this invention.

Figure 8:
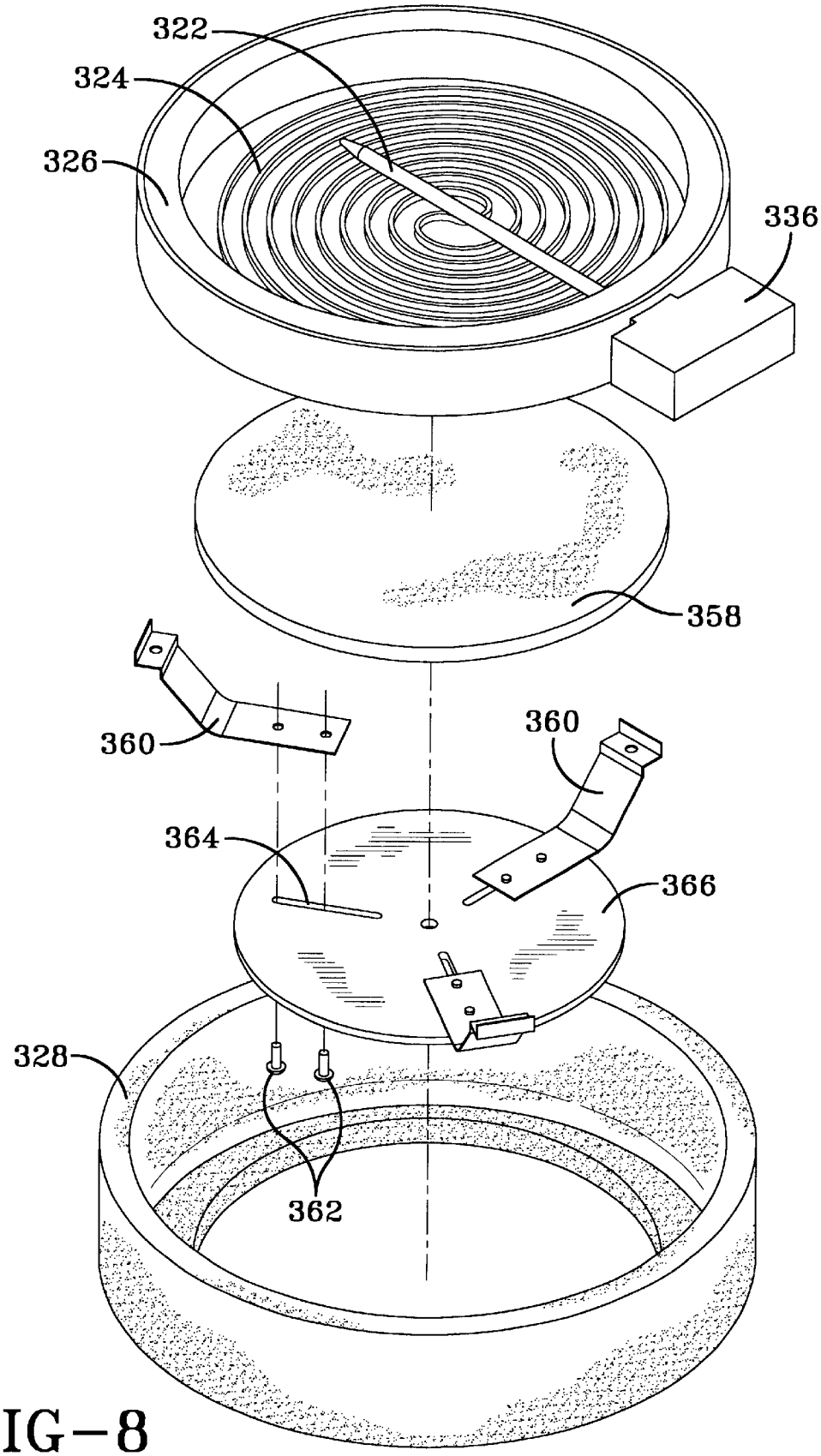
FIG. 8 is a spaced apart schematic view of a single insulated heating element with sensor positioned above the serpentine radiant heating element.

As better illustrated in FIG. 8, which is a spaced apart schematic view of a single insulated heating element with sensor positioned above the heating element, the heating elements 324 of the hot plate unit are surrounded by two circular insulating rings, an inner insulating ring 326 and an outer insulating ring 328 with a bottom inwardly facing shelf dimensioned so as to accommodate an insulating circular plate 358. Secure positioning of the insulating materials about the hot plate heating element are effected via a retaining means, e.g., a plate 366 with a plurality of slots 364 to permit sliding positioning of brackets 360 via fastening means e.g., nuts and bolts or rivets 362.

Figure 11:
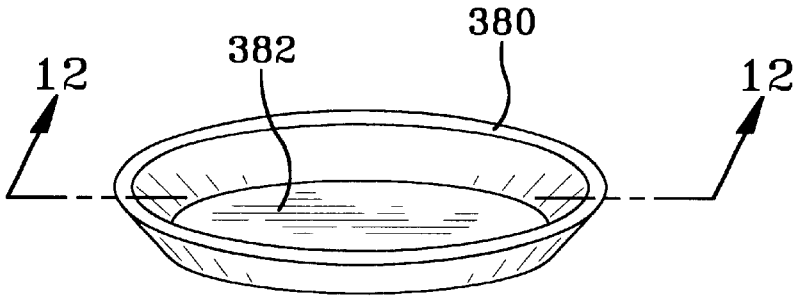
FIG. 11 is an isometric view of a bottom portion of a beveled embodiment of the insulation.
Figure 12:
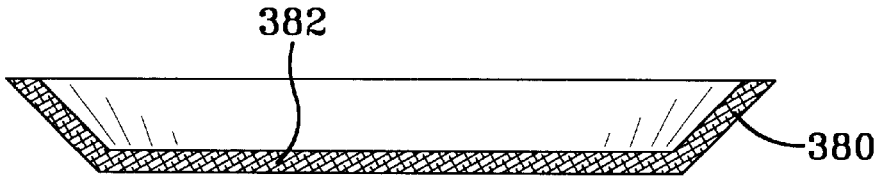
FIG. 12 is an enlarged cross-sectional view of FIG. 11 taken along line 12—12.

While a flat insulating plate 358 is illustrated in FIG. 8, a beveled embodiment is illustrated in FIG. 11, an isometric view of a beveled bottom insulating component, also shown in cross-section in FIG. 12, a cross-section of FIG. 11 taken along line 12—12. In this embodiment, the bottom plate portion 382 has raised beveled sides 380, angled at an angle which can range from 5 to 85°, preferably from 25–65°, more preferably about 45°.

In a preferred embodiment, the insulating means will be SUPERWOOL® 607® board, a rigid self-supporting synthetic vitreous fiber insulation commercially available in a variety of sizes and thicknesses from Vacuform, Sebring, Ohio. This soluble amorphous wool product material has a 1000° C. maximum temperature rating. Superwool 607 board is processed from a slurry consisting of Superwool 607 bulk, fillers, and binders. The Superwool 607 bulk raw material is made from a calcium magnesium silicate composition. Chemically, the material contains approximately the following percentages in a preferred embodiment:

Chemical Analysis (% weight basis after firing)

| Component | Chemical Formula | Percentage |
|---|---|---|
| Alumina | $Al_2O_3$ | — |
| Silica | $SiO_2$ | 67 |
| Calcium oxide | CaO | 27 |
| Magnesium oxide | MgO | 5 |
| Other | | 1 |
| Loss on Ignition | L.O.I. | 4–7 |

Figure 9:
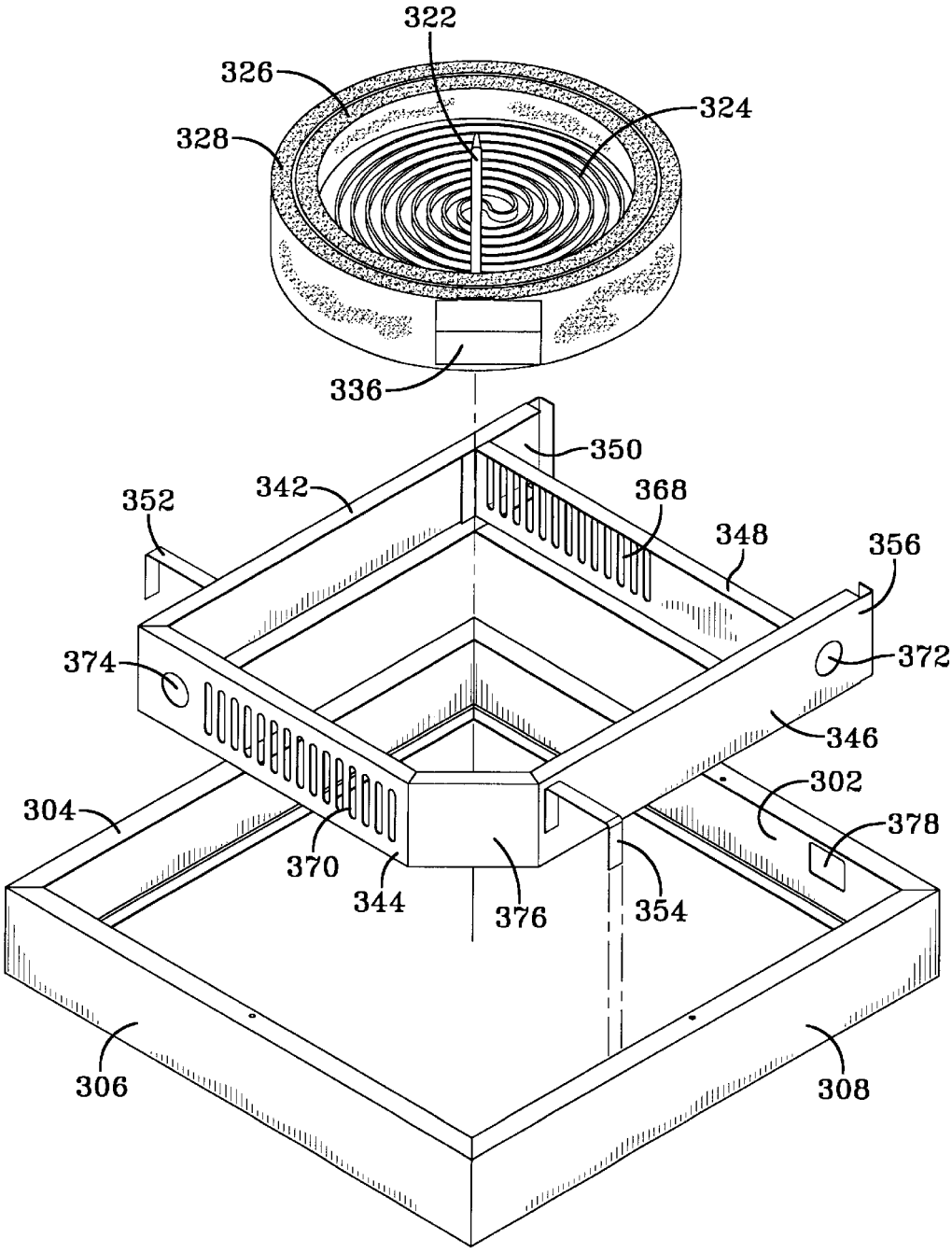
FIG. 9 is a spaced apart schematic view of a single hot plate unit with serpentine radiant heating element positioned within the windowed inner housing which is positioned within the outer housing.

FIG. 9 illustrates a spaced apart schematic view of a single hot plate unit positioned within the windowed inner housing which is positioned within the outer housing. The inner housing is fastened within the outer housing by protruding inner leg extensions 350, 356 or can be effected via clip arrangements 352, 354 or which can be spot welded to the outer housing. Apertures 372, 374 permit electrical wiring harnesses to penetrate between the inner and outer housings while aperture 378 permits electrical communication within attached units. A rubber grommet is typically positioned within each aperture. A plurality of windowed apertures or slits 368, 370 allow any excess accumulated heat to be dissipated from within the inner housing to the interior of the outer housing for ultimate dissipation through egress openings in the bottom floor of the hot plate unit (not shown). While windowed apertures 368, 370 are shown only within inner housing walls 348, 344 respectively, there is no need to limit the invention to such and in fact, all walls may contain these vents or no walls may contain the vents, depending on the design specifications required.

Figure 10:
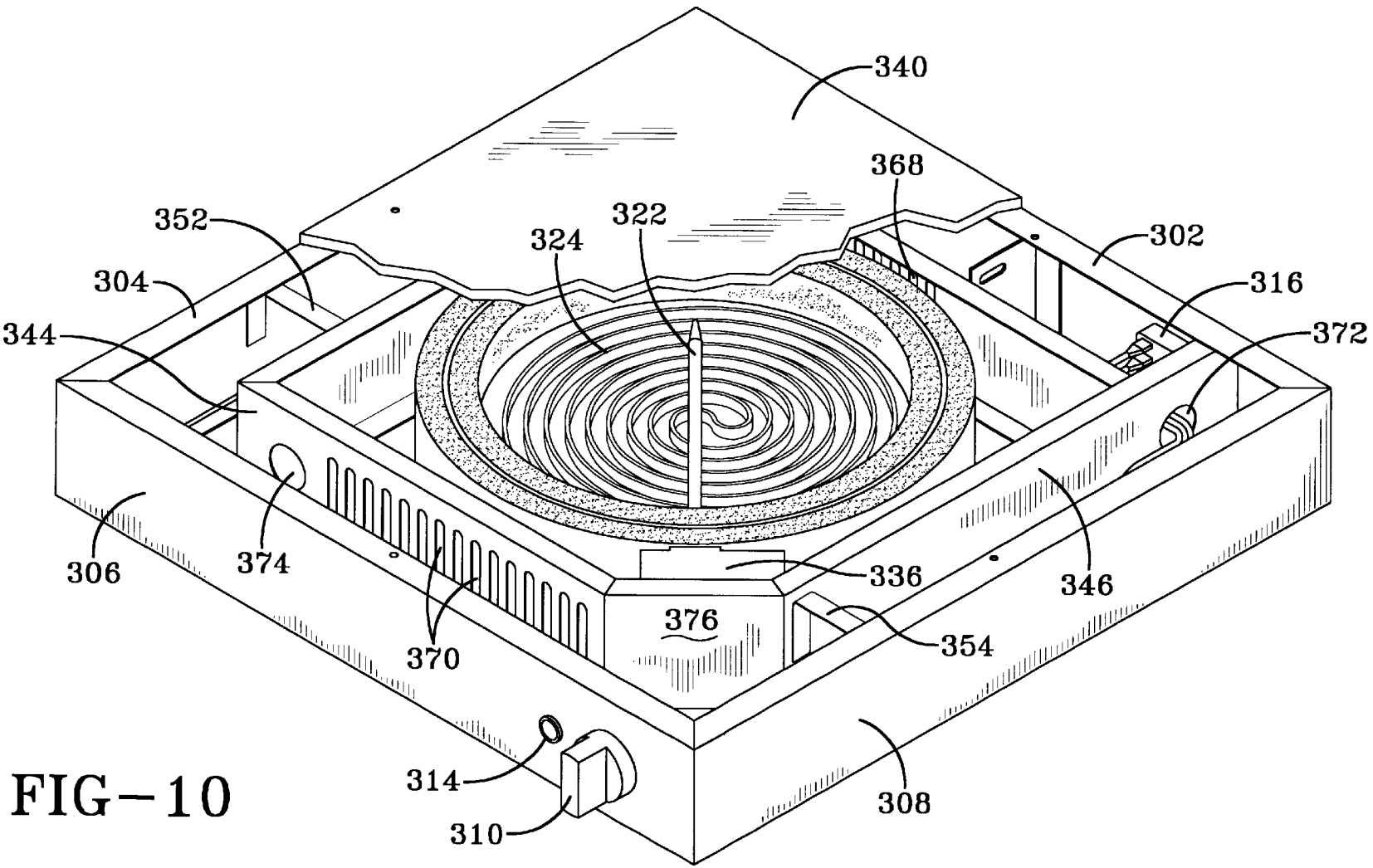
FIG. 10 is a perspective view of an assembled single hot plate unit with vitreous ceramic top partially shown.

As shown in FIG. 10, a perspective view of an assembled single hot plate unit with vitreous ceramic top partially shown, the combination of inner insulating ring 326 coupled with outer insulating ring 328 in combination with insulating circular plate 358, the heat generated by heating elements

324 are directed toward vitreous ceramic surface 340 with minimal lateral and downward heat migration. This permits a hot cooking surface where the cooking pot or pan is positioned while the remainder of the ceramic top and outer housing sides remain significantly cooler, thereby permitting a user to move or reposition the heating units without having to wait for them to cool to the touch.

This invention has been described in detail with reference to specific embodiments thereof, including the respective best modes for carrying out each embodiment. It shall be understood that these illustrations are by way of example and not by way of limitation.

What is claimed is:

1. A hot plate unit comprising:

(a) an outer housing;

(b) at least one inner housing within said outer housing;

(c) one heating element within each of said at least one inner housing;

(d) an insulating means around at least one of said heating elements, wherein said insulating means comprises (i) an inner insulating means;

(ii) an outer insulating means, said outer insulating means comprises a cylinder;

(iii) a bottom insulating means that is cup-shaped having a bottom and beveled raised sides; and (e) a ceramic top on said outer housing.

2. The hot plate of claim 1 wherein (a) said at least one inner housing is connected to said outer housing by at least one fastening means.

3. The hot plate of claim 2 wherein (a) at least one wall of said at least one inner housing has an aperture disposed therein.

4. The hot plate of claim 3 wherein (a) at least two walls of said at least one inner housing has an aperture disposed therein.

5. The hot plate of claim 1 wherein (a) said cylinder has an inwardly facing shelf at a bottom thereof; and (b) said bottom insulating means is essentially plate-like.

6. The hot plate of claim 1 wherein (a) said beveled raised sides are angled at an angle from approximately 5 to 85° inclusive.

7. The hot plate of claim 6 wherein (a) said angle ranges from approximately 25–65° inclusive.

8. The hot plate of claim 7 wherein (a) said angle is approximately about 45°.

9. A hot plate unit comprising:

(a) an outer housing;

(b) at least one inner housing within said outer housing;

(c) one heating element within each of said at least one inner housing;

(d) an insulating means around at least one of said heating elements;

(e) a ceramic top on said outer housing; and (f) at least one other hot plate which forms a portable module having one or more sides of the square or rectangular outlines essentially matching one or more sides of one or more other hot plates of the set when placed in close fitting side by side relationship, wherein each hot plate of the set comprises (i) a vitreous ceramic top covering one or more heating element bodies wherein said vitreous ceramic tops of the set, when the individual hot plates are placed with said matching sides in close fitting contact, combine to form a level top surface, interrupted only by joint lines of minimal width between the vitreous ceramic tops.

10. A hot plate unit comprising:

(a) an outer housing;

(b) at least one inner housing within said outer housing and in contact with said outer housing, said inner housing having at least one wall having at least one aperture disposed therein;

(c) one heating element within each of said at least one inner housing;

(d) at least one insulating means around at least one of said heating elements, wherein said at least one insulating means comprises (i) an inner cylindrical insulating means;

(ii) an outer cylindrical insulating means;

(iii) a bottom insulating means that is cup-shaped having a bottom and beveled raised sides; and (e) a ceramic top on said outer housing.

11. The hot plate of claim 10 wherein (a) said at least one inner housing is connected to said outer housing by a fastening means.

12. The hot plate of claim 11 wherein (a) at least two walls of said at least one inner housing have at least one aperture disposed therein.

13. The hot plate of claim 10 wherein (a) said outer cylindrical insulating means further comprises (i) an inwardly facing shelf at a bottom thereof; and (b) said bottom insulating means is essentially plate-like.

14. The hot plate of claim 10 wherein (a) said beveled raised sides are angled at an angle at an angle from approximately 5 to 85° inclusive.

15. The hot plate of claim 10, wherein (a) said angel ranges from approximately 25–65° inclusive.

16. The hot plate of claim 15 wherein (a) said angle is approximately about 45°.

17. The hot plate of claim 10 which further comprises (a) at least one other hot plate which forms a portable module having one or more sides of square or rectangular outlines essentially matching one or more sides of one or more other hot plates of the set when placed in close fitting side by side relationship.

18. The hot plate of claim 17 wherein each hot plate of the set comprises (a) a vitreous ceramic top covering at least one heating element.

19. The hot plate of claim 18 wherein (a) said vitreous ceramic tops of the set, when the individual hot plates are placed with said matching sides in close fitting contact, combine to form a level top surface, interrupted only by joint lines of minimal width between the vitreous ceramic tops.

* * * * *